US005966772A

United States Patent [19]

Woodnorth et al.

[11] Patent Number: 5,966,772

[45] Date of Patent: Oct. 19, 1999

[54] PAINT SUPPLY AND FINISHING SYSTEM

[75] Inventors: Brian E. Woodnorth, Whitefish Bay; Kenneth L. Shehow, Milwaukee, both of Wis.

[73] Assignee: Newell Operating Co., Freeport, Ill.

[21] Appl. No.: 08/966,825

[22] Filed: Nov. 10, 1997

[51] Int. Cl.[6] ..... B05C 17/02; B05C 21/00

[52] U.S. Cl. ..... 15/230.11; 15/257.06; 118/258; 206/229; 220/23.87; 220/570; 220/495.02; 492/13; 492/19; D4/122; D4/123; D32/53.1

[58] Field of Search ..... 15/257.05, 257.06, 15/230.11; 118/211, 244, 258, DIG. 14, DIG. 15; 220/495.02, 528, 23.83, 23.86, 23.87, 23.88, 570; 401/119, 218; 492/13, 19; D4/122, 123; D32/53.1; 206/209, 229

[56] References Cited

U.S. PATENT DOCUMENTS

| | | | |
|---|---|---|---|
| D. 230,086 | 1/1974 | Meisner | D32/53.1 |
| D. 332,512 | 1/1993 | Bernard | D32/53.1 |
| 2,321,511 | 6/1943 | Piercy | 15/230.11 |
| 2,625,702 | 1/1953 | Grubbs | 15/257.05 X |
| 2,680,873 | 6/1954 | Ernst | 15/230.11 X |
| 2,693,893 | 11/1954 | Rice et al. | 492/13 |
| 2,731,996 | 1/1956 | Hayes | 220/528 X |
| 2,735,128 | 2/1956 | Adams | 15/230.11 |
| 2,778,050 | 1/1957 | Meinhardt | 15/257.06 X |
| 2,799,884 | 7/1957 | Bedford | 15/230.11 |
| 2,838,781 | 6/1958 | Molle | 15/257.06 |
| 2,881,461 | 4/1959 | Parker | 15/230.11 |
| 2,909,797 | 10/1959 | White | 15/257.06 |
| 2,982,981 | 5/1961 | Waara | 15/230.11 X |
| 3,008,167 | 11/1961 | Pharris et al. | 15/230.11 |
| 3,157,902 | 11/1964 | Hardwick | 15/257.06 |
| 3,273,700 | 9/1966 | Moreau et al. | 220/528 X |
| 3,474,482 | 10/1969 | Burns et al. | 15/230.11 |
| 3,501,044 | 3/1970 | Stone | 220/23.4 |
| 3,554,659 | 1/1971 | Stokes | 401/197 |
| 3,562,837 | 2/1971 | Baginski et al. | 15/230.11 |
| 3,609,049 | 9/1971 | Smyth | 401/118 |
| 3,649,986 | 3/1972 | Dahlund | 15/230.11 |
| 3,745,624 | 7/1973 | Newman | 492/19 |
| 3,970,396 | 7/1976 | Brady | 401/208 |
| 4,029,011 | 6/1977 | Kurner | 401/218 X |
| 4,164,299 | 8/1979 | Fuhr | 220/255 |
| 4,164,803 | 8/1979 | Zurawin et al. | 15/257.05 |
| 4,191,792 | 3/1980 | Janssen | 427/260 |

(List continued on next page.)

FOREIGN PATENT DOCUMENTS

| | | | |
|---|---|---|---|
| 1565411 | 5/1969 | France | 220/528 |
| 1035022 | 7/1958 | Germany | 15/257.06 |
| 9002017 | 9/1990 | Netherlands . | |
| 1378902 | 12/1974 | United Kingdom . | |

OTHER PUBLICATIONS

EZ Paintr Catalog, Excerpts from Paint Applicators for the Professional; 4 pages; undated.

Brochure entitled *Express Yourself, Easy Faux Finishes* by Decorightor™ Faux Finisher, located in Oakdale, Minnesota; undated.

Brochure entitled *Color, A Stroke of Brilliance* by Leslie Harrington; copyright 1993 by Benjamin Moore & Co. Limited, Toronto, Canada; Fifth Printing–1995; 4 pages.

*Primary Examiner*—Mark Spisich
*Attorney, Agent, or Firm*—Foley & Lardner

[57] ABSTRACT

A paint supply and finishing system includes a tray and a paint roller. The tray includes a floor, a plurality of upstanding walls extending from the floor to form a basin and a partitioning wall configured for being removably positioned within the basin to create first and second pans within the basin configured for receiving roller covers. The pans preferably include at least one paint metering medium. The paint roller includes a handle, a continuous elongate shaft coupled to the handle, a first roller cover rotatably supported about the shaft and a second roller cover rotatably supported about the shaft. The first and second roller covers are axially spaced from one another so as to independently rotate relative to one another and so as to be simultaneously positionable within the first and second pans.

26 Claims, 5 Drawing Sheets

U.S. PATENT DOCUMENTS

| | | | |
|---|---|---|---|
| 4,233,705 | 11/1980 | Lepage et al. | 15/257.06 |
| 4,257,140 | 3/1981 | Downing | 15/230.11 |
| 4,434,521 | 3/1984 | Martin et al. | 15/230.11 |
| 4,467,509 | 8/1984 | Dezen | 492/19 |
| 4,705,168 | 11/1987 | Ward | 206/373 |
| 4,800,845 | 1/1989 | Budd | 220/495.02 X |
| 4,897,893 | 2/1990 | Barker | 15/230.11 |
| 4,937,909 | 7/1990 | Georgiou | 15/230.11 |
| 5,117,529 | 6/1992 | Ohta | 15/230.17 |
| 5,167,055 | 12/1992 | Stoddart et al. | 492/13 |
| 5,178,274 | 1/1993 | Long | 206/361 |
| 5,206,979 | 5/1993 | Campbell | 492/13 |
| 5,386,611 | 2/1995 | Kim | 15/230.11 |
| 5,400,916 | 3/1995 | Weber | 15/257.06 X |
| 5,437,593 | 8/1995 | Gustavsen | 492/13 |
| 5,439,108 | 8/1995 | Lackie | 220/528 X |
| 5,471,703 | 12/1995 | Niven | 15/230.11 |
| 5,511,279 | 4/1996 | Ippolito | 15/257.06 |
| 5,533,228 | 7/1996 | Jarecki et al. | 15/257.06 |
| 5,713,095 | 2/1998 | Wakat | 15/230.11 |

FIG. 10
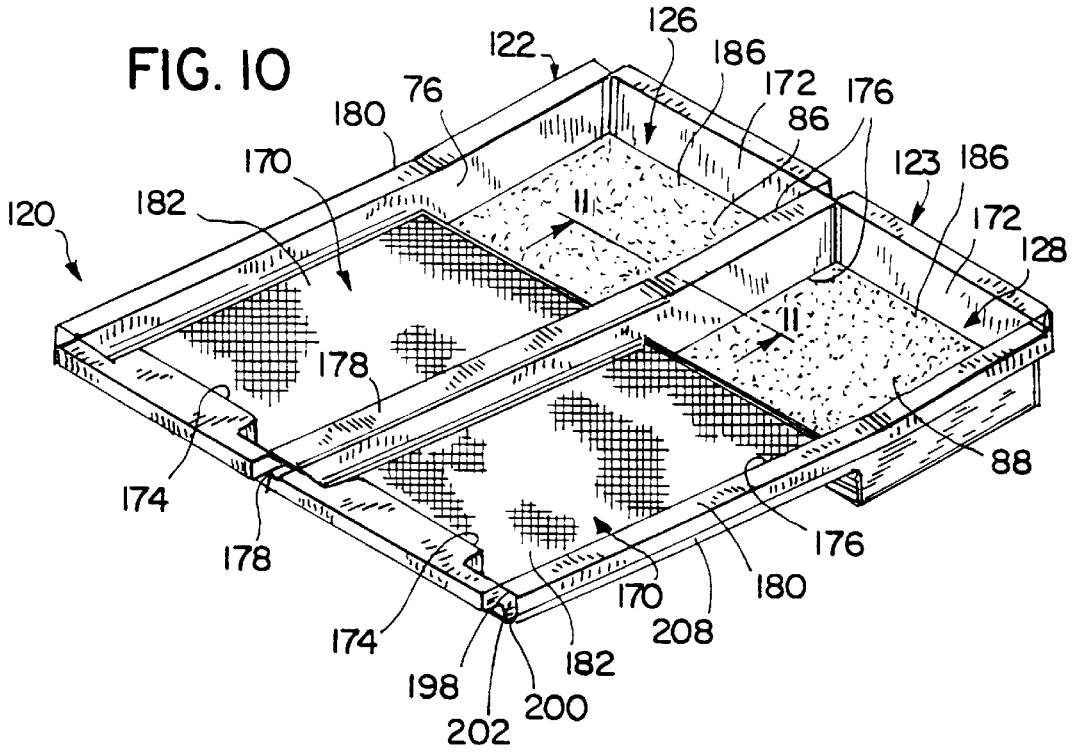
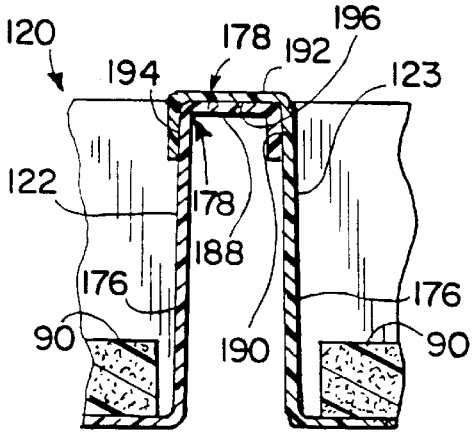
FIG.11
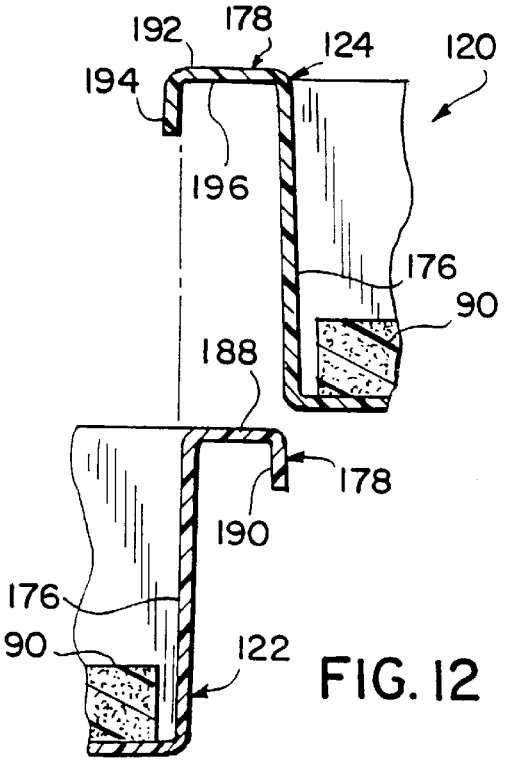
FIG. 12

PAINT SUPPLY AND FINISHING SYSTEM

FIELD OF THE INVENTION

The present invention relates to paint supply and finishing systems. In particular, the present invention relates to a versatile paint roller and paint tray system for applying a single color or a plurality of colors to achieve various paint finishes.

BACKGROUND OF THE INVENTION

Faux finishing processes, such as sponging, stippling and rag rolling, are popularly used to create various textures, patterns or attractive combinations of colors on walls or surfaces using various types of surface coatings (hereinafter collectively referred to as "paint"). To achieve the faux finish, the paint is applied using sponges, rags or other paint applicators. However, the techniques employing such sponges, rags and other paint applicators are labor intensive, time consuming and require great skill to produce an attractive finish.

To reduce the time, labor and skill necessary for creating a faux finish, paint supply and finishing systems employing paint rollers have been developed. These systems include a bifurcated roller and a three compartment paint tray. The bifurcated roller includes a handle supporting two distinct shafts which rotatably support cages configured to receive roller covers. The three compartment tray is a generally rectangular basin having two integrally molded partitions which divide the basin into three elongate compartments. Each compartment includes a ramp and a deep well. The ramp includes an integrally molded grid. To prevent the paint rollers from absorbing too much paint, the tray additionally includes insertable plastic grids which are positioned within the wells to limit the extent to which the rollers may be dipped into the wells.

To create a desired faux finish, different colors of paint are poured into each of the compartments of the tray. Depending upon the desired finish, either standard roller covers or patterned roller covers are positioned on the cages of the bifurcated roller and are simultaneously lowered into the different paint colors contained in adjacent compartments of the paint tray. To remove excess paint from the roller covers, the covers are rolled across the grids or are rolled across scrap paper. The two roller covers are then rolled across the wall or surface to simultaneously apply the two paint colors in an overlapping fashion.

Although the described systems reduce the time and skill necessary to create attractive faux finishes, the bifurcated roller and the three compartment tray of there systems have several disadvantages. Because the roller is bifurcated, the roller frame can only be used for supporting two spaced apart roller cages and roller covers. As a result, the bifurcated roller frame is limited to particular faux finishing techniques and cannot be utilized for the conventional application of paint to walls and other surfaces. Because the handle must support two separate bifurcated shafts, the manufacture of the handle is complex and expensive. In addition, because the handle must support the two bifurcated shafts, the handle is subject to cracking and failure.

Moreover, the three compartment paint tray and the associated plastic grids waste paint and are difficult to use. Because each of the compartments contains different colors of paint, it is extremely difficult to pour the different colors of the unused paint back into their original containers for storage. Moreover, because the tray and insertable plastic grids frequently allow paint rollers to carry too much paint, the excess paint must be removed by rolling the rollers across the grids and also across scrap paper. The frequent necessity of removing excess paint from the rollers increases the time required to finish the surface and wastes paint.

As a result, there is a continuing need for an improved paint supply and finishing system that is simpler to manufacture, easier to use, more durable, less wasteful and more versatile.

SUMMARY OF THE INVENTION

The present invention is directed to a paint roller and tray system including a tray and a paint roller. The tray includes a floor, a plurality of upstanding walls extending from the floor to form a basin and a partitioning wall configured for being removably positioned within the basin to create first and second pans within the basin and configured for simultaneously receiving roller covers. The paint roller includes a handle, a continuous elongate shaft coupled to the handle, a first roller cover rotatably supported about the shaft and a second roller cover rotatably supported about the shaft. The first and second roller covers are axially spaced from one another so as to independently rotate relative to one another and so as to be simultaneously positionable within the first and second pan.

In the exemplary embodiment illustrated, the paint roller includes first roller cages independently rotatable about the shaft, wherein the first and second cages rotatably support the first and second roller covers. The exemplary embodiment additionally includes a spacer positioned between the first and second roller covers.

In the exemplary embodiment illustrated, the partitioning wall of the paint roller and tray system includes a top surface while the paint roller includes an intermediate surface axially extending between the first and second roller covers. The top surface of the partitioning wall and the intermediate surface of the paint roller interact with one another to regulate insertion of the first and second roller covers into the first and second pans.

In one exemplary embodiment, the paint supply system includes a receptacle configured for being received within the basin and for receiving roller covers. In another exemplary embodiment illustrated, the partitioning wall is configured for being releasibly attached to the tray. In one embodiment, the system includes a plurality of receptacles configured for being simultaneously received within the basin for simultaneously receiving roller covers.

The system also preferably includes a paint absorbent medium within at least one of the first and second pans. The paint metering medium meters or provides a variable amount of paint to the paint roller covers based upon the pressure or force applied to the medium by the roller covers. In the preferred embodiment, the paint metering medium comprises a paint absorbent medium. The medium absorbs paint and releases paint onto the roller cover when in contact with the roller cover. The paint metering medium preferably comprises a paint absorbing foam. Preferably, the first and second pans include a well containing the paint metering medium and a ramp extending from the well.

The present invention is also directed to a roller frame including a handle, a continuous elongate shaft coupled to the handle, a first roller cage rotatably supported about the shaft and a second roller cage rotatably supported about the shaft. The first and second cages are axially spaced from one another for independent rotation relative to one another when supporting distinct covers.

The present invention is also directed to a roller assembly including a handle, a continuous elongate shaft coupled to the handle, a first roller cover rotatably supported about the shaft and a second roller cover rotatably supported about the shaft. The first and second roller covers are axially spaced from one another for independent rotation relative to one another.

The present invention is also directed to a tray insert for use with a tray having a floor and a plurality of upstanding walls forming a basin. The tray insert includes a partitioning wall configured for being removably positioned within the basin so as to divide the basin into a plurality of distinct pans configured for receiving roller covers. The partitioning wall is configured for being releasibly attached to the tray. The insert preferably includes a plurality of upstanding walls and a floor, wherein the plurality of upstanding walls and the partitioning wall extend from the floor to form a receptacle configured for being received within the basin. The insert preferably includes a paint metering medium within the pan.

The present invention is also directed to a paint supply system for use with a roller. The system includes a floor, a plurality of upstanding walls extending from the floor to form a basin, and a paint metering medium within the basin. Paint metering medium preferably comprises a paint metering medium, wherein the medium absorbs paint and releases paint onto the roller when in contact with the roller.

The present invention is also directed to a paint supply system for use with the roller having a plurality of spaced roller covers. The system includes a tray and first and second paint receptacles. The tray has a floor and a plurality of upstanding walls extending from the floor to form a basin. The first and second paint receptacles are configured for being simultaneously received within the basin. Each receptacle includes a floor and a plurality of upstanding walls extending from the floor to a pan. Adjacent walls of adjacent receptacles are sized such that adjacent receptacles may simultaneously receive independent roller covers supported by a single handle.

BRIEF DESCRIPTION OF THE DRAWINGS

FIG. 10 is a perspective view of an alternative embodiment of the insert shown in FIG. 2.

FIG. 11 is a fragmentary sectional view of the insert taken along lines 11—11 of FIG. 10.

FIG. 12 is a fragmentary sectional view of the tray insert of FIG. 11 illustrating separation of individual pans of the tray insert.

DETAILED DESCRIPTION OF THE PREFERRED EMBODIMENTS

Figure 1:
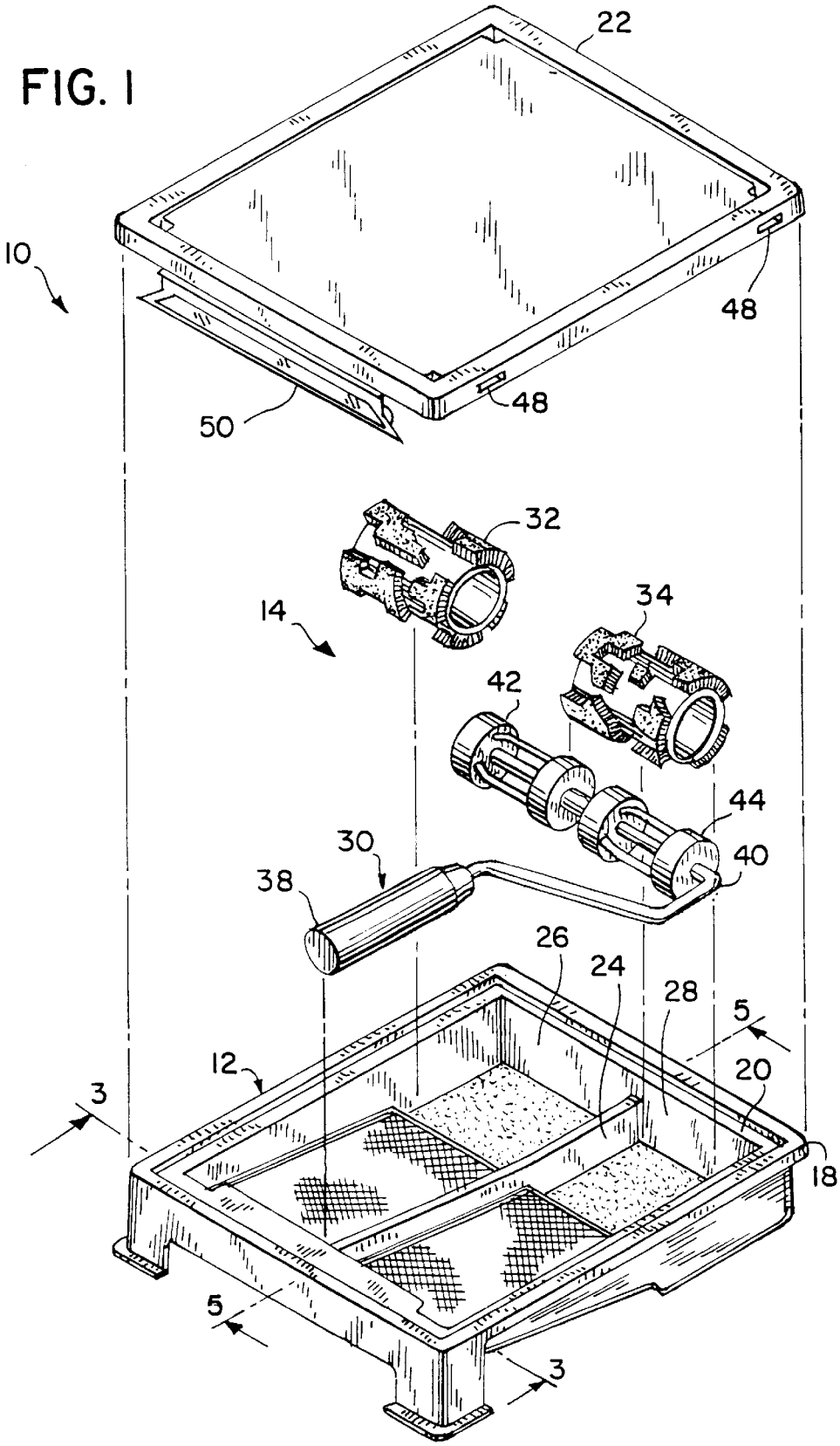
FIG. 1 is an exploded perspective view of a paint supply and finishing system including a paint supply system and a roller system.

FIG. 1 is an exploded perspective view of a paint supply and finishing system 10 which generally includes paint supply system 12 and roller system 14. Paint supply system 12 supplies multiple colors of paint to roller system 14. Paint supply system 12 includes tray 18, insert 20 and cover 22. As shown by FIG. 1, insert 20 is configured for being removably positioned within tray 18 and includes a partitioning wall 24 that divides tray 18 into two side-by-side pans 26 and 28. Pans 26 and 28 contain paint and supply paint to roller system 14.

Roller system 14 applies the different colors of paint contained within paint supply system 12 to the wall or other surface being finished. Roller system 14 includes roller frame 30 and roller covers 32, 34. Roller frame 30 includes a handle 38, a shaft 40 and cages 42, 44. Shaft 40 is a continuous elongate rod coupled to and extending from handle 30. Shaft 40 rotatably supports cages 42 and 44. Cages 42 and 44 comprise conventionally known roller cages and are rotatably supported about an axis of shaft 40. Cages 42 and 44 are axially spaced from one another so as to rotate independently of one another even when supporting roller covers 32 and 34.

Roller covers 32 and 34 are conventionally known and are sized for being positioned over and for being supported by cages 42 and 44, respectively. As with cages 42 and 44, covers 32 and 34 are axially spaced from one another along shaft 40 so as to rotate independent of one another.

Cover 22 is a substantially flat cover configured so as to be releasibly attached to tray 18 for covering the interior of tray 18. Cover 22 is conventionally known and includes locking tabs 48 positioned about its perimeter and an additional locking member 50 at one end. Locking tabs 48 and locking member 50 engage tray 18 to seal cover 22 against tray 18. As a result, unused paint within tray 18 may be stored within tray 18 without the paint drying. Lid 22 also prevents the paint stored within tray 18 from accidentally spilling.

Figure 3:
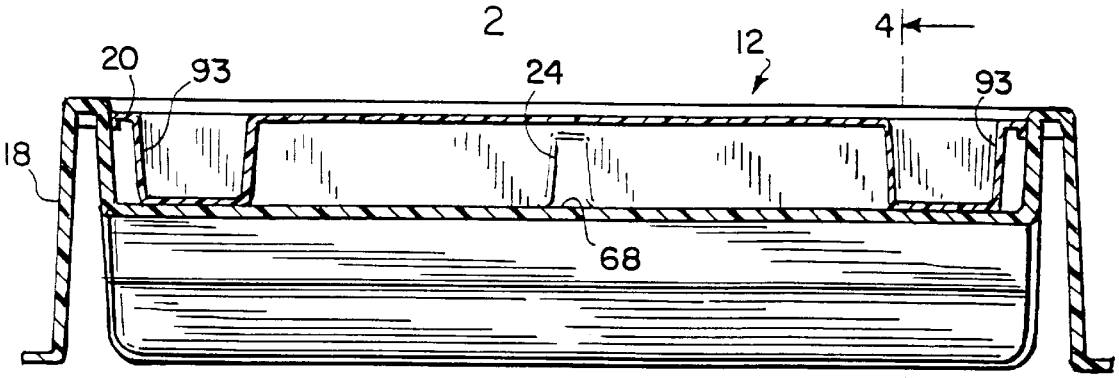
FIG. 3 is a sectional view of the paint supply system taken along lines 3—3 of FIG. 1.
Figure 4:
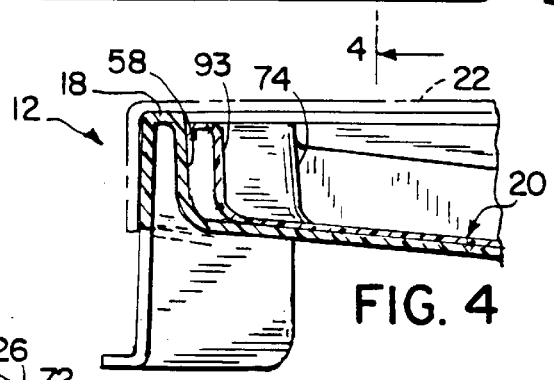
FIG. 4 is a fragmentary sectional view of the paint supply system taken along lines 4—4 of FIG. 3.
Figure 2:
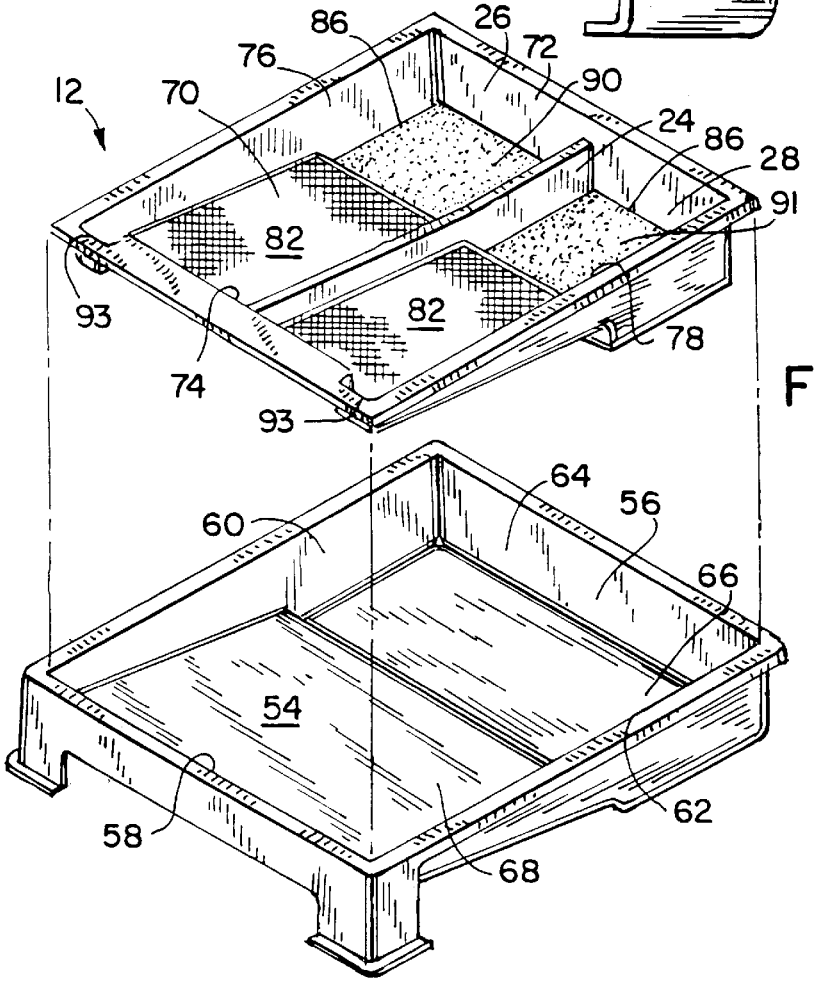
FIG. 2 is an exploded perspective view the paint supply system of FIG. 1 including a tray and an insert.

FIGS. 2–4 illustrate paint supply system 12, excluding cover 22, in greater detail. As best shown by FIG. 2, tray 18 includes floor 54, front wall 56, rear wall 58 and side walls 60, 62. Walls 56, 58, 60 and 62 extend upwardly from floor 54 to form a generally rectangular basin 64. Floor 54 is preferably configured so as to form a well 66 and a ramp 68 along a bottom of basin 64. As a result, tray 18 may be used with conventional longer roller covers for the conventional painting of walls and other surfaces using a single color paint. As can be appreciated, tray 18 may have a variety of alternative shapes and dimensions depending upon the configuration of insert 20. For example, tray 18 may additionally include legs or other attachments for securing tray 18 to a latter or other structure.

Insert 20 preferably comprises a receptacle configured for being removably positioned within basin 64 of tray 18 so as to serve as a liner for basin 64. Insert 20 includes floor 70, front wall 72, rear wall 74, side walls 76, 78 and partitioning wall 24. Walls 72, 74, 76, 78 and 24 extend upwardly from floor 70 to form pans 26 and 28. Pans 26 and 28 are generally elongate channels configured for receiving roller covers 32 and 34 of roller system 14 (shown in FIG. 1). Partitioning wall 24 preferably has a reduced height to facilitate the positioning of roller covers 32 and 34 simultaneously into pans 26 and 28, respectively.

As further shown by FIG. 2, floor 70 of pans 26 and 28 is configured so as to form ramps 82 and wells 86. Ramps 82 extend from rear wall 74 downwardly towards wells 86 adjacent front wall 72. Ramps 82 preferably includes dimples, grids or other elevated portions for enabling excess paint on the roller covers to be removed. Excess paint removed from the roller covers drains towards wells 86 for further use.

Wells 86 provide reservoirs for containing the paint. In the preferred embodiment, wells 86 include paint metering mediums 90. Paint metering mediums 90 meter an amount of paint to roller covers 32 and 34. In particular, mediums 90 make available an amount of paint to covers 32 and 34 depending upon the pressure applied to mediums 90 by roller covers 32 and 34. Mediums 90 preferably comprise a paint absorbent material which absorbs the paint within wells 86 and releases the absorbed paint onto roller covers 32 and 34 when compressed by roller covers 32 and 34. As a result, paint metering mediums 90 prevent roller covers 32 and 34 from absorbing an excessive amount of paint. This is extremely important when performing a dry roller faux finishing technique. Paint metering mediums 90 are preferably removably positioned within wells 86 so as to enable mediums 90 to be removed for cleaning, replacement or for performing other faux finishing techniques. In the embodiment illustrated, paint metering mediums 90 each preferably comprise a paint absorbing foam. Alternatively, paint metering mediums 90 may be made of other materials and may have other structures which meter paint to rollers 32 and 34 such as floating grids, rolled wire mesh and the like. Other structures may also be used which utilize wicking or capillary action to meter the amount of paint made available to rollers 32 and 34.

As best shown by FIGS. 2–4, insert 20 additionally includes pour spouts 93 adjacent rear wall 74 and side walls 76. Pour spouts 93 are integrally molded as part of rear wall 74 in the corners of pans 26 and 28. Pour spouts 93 enable different colored unused paint within trays 26 and 28 to be easily returned to different containers for storage and later use.

Figure 5:
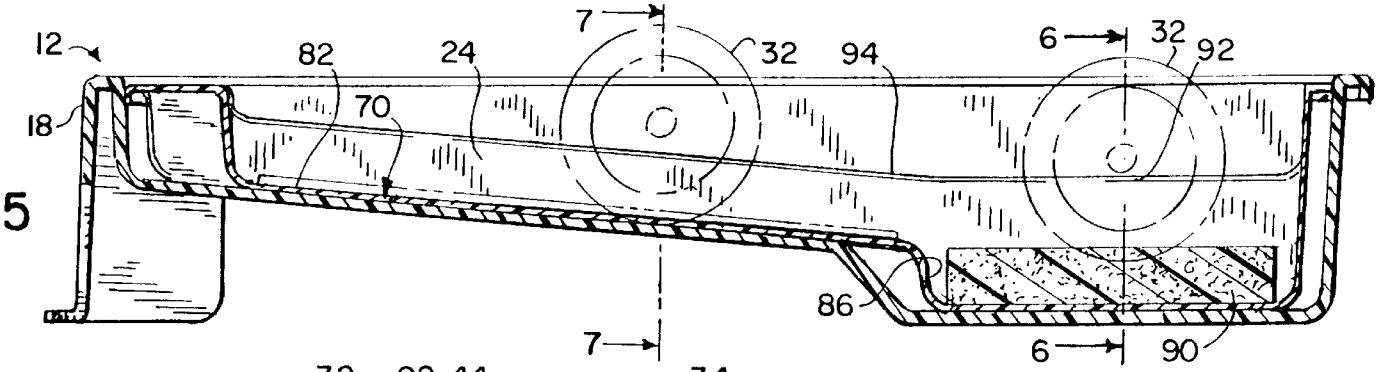
FIG. 5 is a sectional view of the paint supply system taken along lines 5—5 of FIG. 1 with the roller system shown in phantom.
Figure 6:
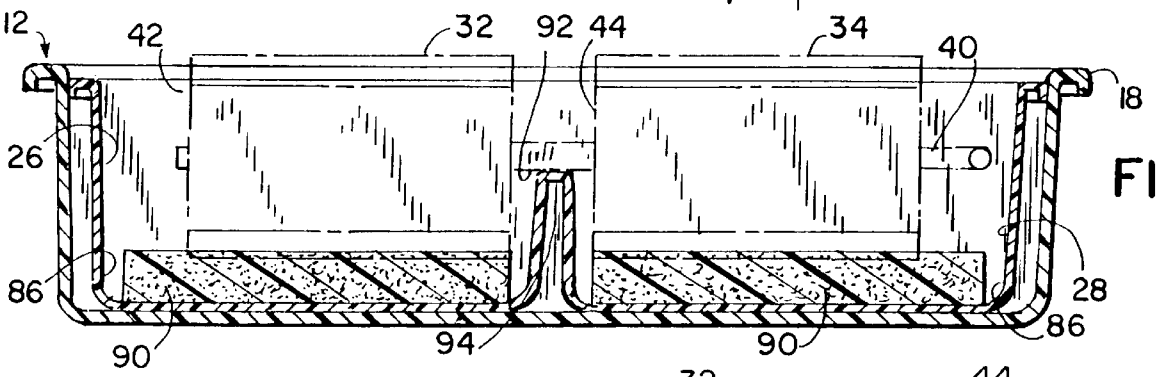
FIG. 6 is a sectional view of the paint supply system and the roller system taken along lines 6—6 of FIG. 5.
Figure 7:
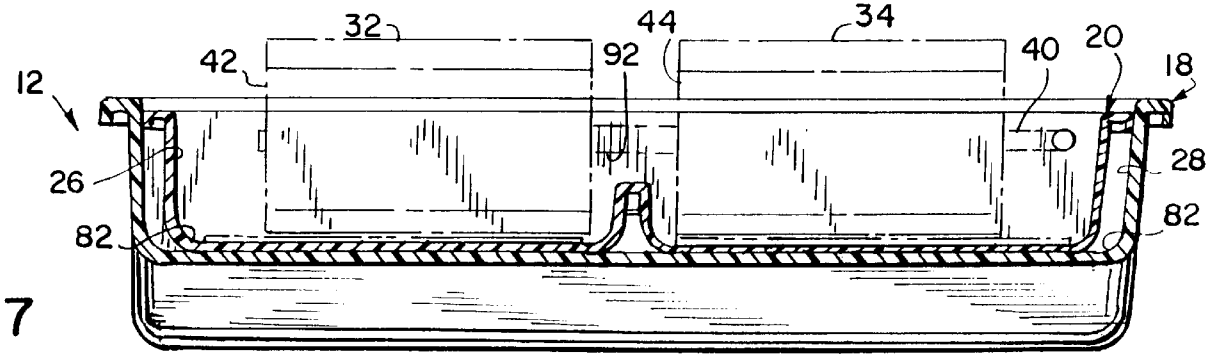
FIG. 7 is a sectional view of the paint supply system and the roller system taken along lines 7—7 of FIG. 5.

FIGS. 5–7 illustrate roller covers 32 and 34 (shown in phantom) simultaneously positioned within pans 26 and 28, respectively, to absorb the different colors of paint. As best shown by FIGS. 5 and 6, roller 30 includes an intermediate surface 92 axially extending between roller covers 32 and 34. Partitioning wall 24 includes an upper surface 94 extending above wells 86 and 88. Surface 94 interacts with intermediate surface 92 to regulate the insertion of roller covers 32 and 34 into wells 86 and 88 of pans 26 and 28, respectively. At the same time, the interaction of surfaces 92 and 94 do not prevent roller covers 32 and 34 from being rolled back and forth towards and away from front wall 72 to apply paint to the entire outer circumference of roller covers 32 and 34. Thus, interaction of surfaces 92 and 94 prevents roller covers 32 and 34 from being dipped into the paint within wells 86 to prevent roller covers 32 and 34 from absorbing an excessive amount of paint. Moreover, when used with mediums 90, the interaction of surfaces 92 and 94 limit the degree to which covers 32 and 34 are depressed into paint metering mediums 90 to also limit the amount of paint absorbed by covers 32 and 34.

As shown by FIGS. 5 and 7, partitioning wall 24 is preferably dimensioned so as to extend above ramps 82 by a distance such that intermediate surface 92 does not interact with the top of partitioning wall 24 while roller covers 32 and 34 are rolled across ramps 82. Consequently, rollers 32 and 34 may be pressed against the surfaces of ramps 82 with a sufficient amount of pressure to further remove any excess paint from roller covers 32 and 34 prior to rolling roller covers 32 and 34 across the wall or surface to be finished.

Figure 8:
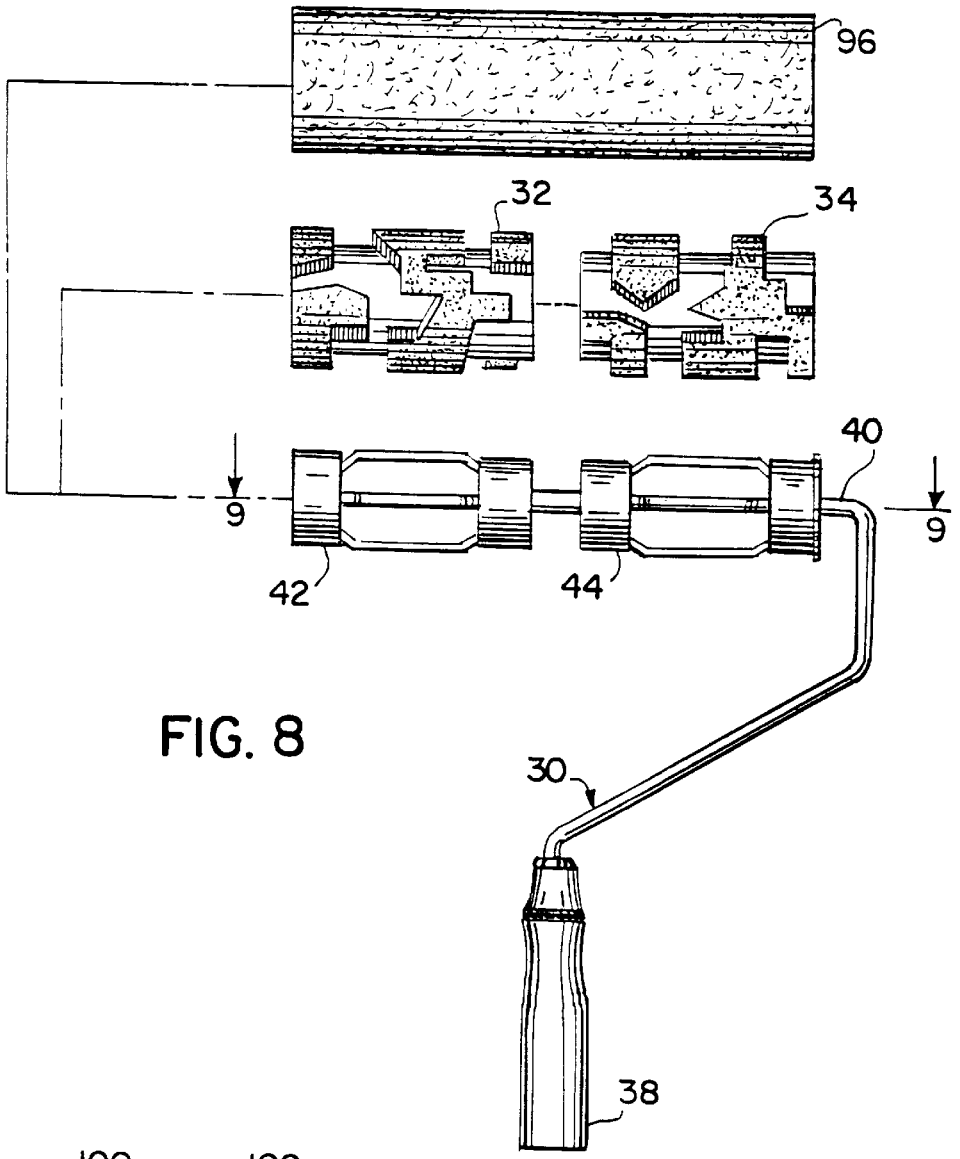
FIG. 8 is a top elevational view of the roller system including a roller and roller covers.

FIG. 8 illustrates roller system 14 in greater detail. As best shown by FIG. 8, roller 30 is versatile such that cages 42 and 44 may be used to support individual roller covers, such as roller covers 32 and 34 axially spaced along shaft 40, or may be used to alternatively support a conventional elongate roller cover 96. Consequently, roller 30 may be used for both conventional painting using cover 96 or specialized faux finishing techniques using covers 32 and 34.

As conventionally known, roller covers 32 and 34 are generally tubular shaped members having a hollow core sized for receiving cages 42 and 44 and an outer circumferential surface adapted for absorbing and applying paint as the outer surface is rolled over a wall or other surface. In the exemplary embodiment illustrated, covers 32 and 34 have patterned outer circumferential surfaces so as to apply specific patterns to the wall or other surface. Alternatively, covers 32 and 34 may comprise conventionally known standard roller covers having a continuous paint absorbing material. As further known, roller cover 96 has a generally elongate tubular core supporting an outer circumferential surface including a paint absorbing material. The core of cover 96 is sized and configured for receiving both cages 42 and 44. Because covers 32, 34 or 96 may be positioned about cages 42 and 44 or may alternatively be removed from cages 42 and 44, covers 34, 36 or 96 may be removed for cleaning or replacement.

Figure 9:
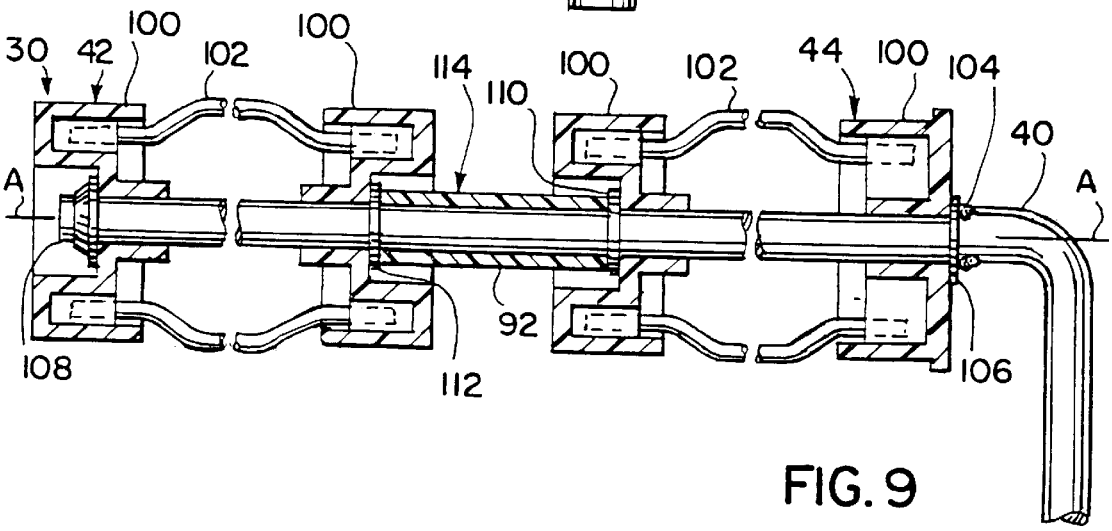
FIG. 9 is a sectional view of the roller taken along lines 9—9 of FIG. 8.

FIG. 9 illustrates shaft 40 and cages 42, 44 of roller 30 in greater detail. FIG. 9 is a sectional view of roller 30 taken along lines 9—9 of FIG. 8. As best shown by FIG. 9, shaft 40 is a single elongate rod extending through both cages 42 and 44 to rotatably support cages 42 and 44 about axis A. Cages 42 and 44 each include a pair of hubs 100 journaled about shaft 40 and interconnected by wires 102. Wires 102 are outwardly angled for frictional engagement with inner circumferential surfaces of covers 32 and 34 or cover 96. As a result, wires 102 prevent slippage of roller covers 32 and 34 or cover 96.

As further shown by FIG. 9, roller 30 additionally includes bead 104, washer 106 and end cap 108 for capturing cages 42 and 44 axially along shaft 40. Bead 104 integrally projects from shaft 40 and engages washer 106 adjacent cage 44 at a first end of shaft 40. End cap 108 is axially secured to shaft 40 adjacent cage 42 at a second end of shaft 40 to capture cages 42 and 44 therebetween while permitting rotation of cages 42 and 44 about shaft 40. As further shown by FIG. 9, cages 42 and 44 are axially spaced from one another by washers 110, 112 and spacer 114. Washers 110 and 112 extend outwardly beyond shaft 40 and engage cages 44 and 42, respectively. Spacer 114 comprises a generally elongate stiff cylindrical tube encircling shaft 40 and captured between washers 110 and 112. Washer 110 and 112 and spacer 114 axially space cages 42 and 44 apart from one another a sufficient distance such that when roller covers 32 and 34 are positioned about cages 42 and 44, respectively, covers 32 and 34 do not interfere with the independent rotation of the other about shaft 40. In the preferred embodiment illustrated, spacer 114 is rotatably positioned about shaft 40 such that spacer 114 rotates about shaft 40. Consequently, spacer 92 minimizes the frictional resistance between spacer 114 and cages 42 and 44 and also facilitates rolling spacer 114 across top surface 94 as roller covers 32 and 34 are absorbing paint within wells 86.

As can be appreciated, cages 42 and 44 as well as covers 32 and 34 may be axially spaced from one another about shaft 40 by a variety of distances and by a variety of alternative structures. For example, cages 42 and 44 as well covers 32 and 34 may be positioned closer to one another by utilizing a shorter spacer 114 in conjunction with additional spacers 114 between washer 106 and cage 44 and between end cap 108 and cage 42. Cages 42 and 44 as well as covers 32 and 34 may also be axially spaced farther apart from one another by utilizing a longer shaft 40 in conjunction with a longer spacer 114. Because cages 42 and 44 are supported by a single elongate continuous shaft 40, the spacing between cages 42 and 44 may be adjusted to provide a selected, desired paint finish to the wall or surface being painted. In lieu of spacer 114, other structures could be used for slidably positioning cages 42 and 44 as well as covers 32 and 34 along shaft 40 and releasibly locking cages 42 and 44 and covers 32 and 34 in place axially along shaft 40 to provide the desired spacing therebetween. Moreover, cages 42 and 44 may also comprise other known cage structures integrally formed from plastic and including various mechanisms used to prevent slippage of the supported roller cover relative to the cage.

FIGS. 10–12 illustrate a tray insert 120, a second embodiment of tray insert 20 shown in FIGS. 1–7. As best shown by FIG. 10, tray insert 120 includes two individual receptacles 122, 123 configured for being simultaneously positioned adjacent one another within basin 64 of tray 18. Each receptacle 122, 123 includes a floor 170, a front wall 172, a rear wall 174, a pair of side walls 176, a receptacle connector 178 and a tray connector 180. Floor 170 and walls 172, 174 and 176 of receptacles 122, 123 form pans 126 and 128, respectively. Pans 126 and 128 are configured for containing paint and for receiving roller covers 32 and 34. Similar to floor 70 of insert 20, floors 170 of receptacles 122 and 123 are configured so as to form ramps 182 and wells 186. Ramps 182 slope downwardly from rear walls 174 towards front walls 172. Ramps 182 preferably include integrally formed dimples or grids to assist the removal of excess paint from roller covers 32 and 34. Wells 186 act as reservoirs for paint and preferably receive paint metering mediums 90.

Receptacle connectors 178 extend along adjacent side walls 176 of receptacles 122, 123 and are configured for engaging one another so as to releasibly interconnect receptacles 122 and 123. Connectors 178 are preferably configured so as to prevent horizontal movement of receptacles 122 and 123 relative to one another. As best shown by FIGS. 11 and 12, in the exemplary embodiment illustrated, connectors 178 comprise overlapping and interconnecting rims. In particular, connector 178 of receptacle 122 includes an outwardly extending flange 188 and a downwardly turned wall 190. Connector 178 of receptacle 123 includes a horizontal flange 192 and a downwardly turned wall 194. Flange 192 and wall 194 are configured so as to form an elongate channel 196 configured for mating with and receiving flange 188 and wall 190 so as to releasibly interconnect receptacles 122 and 123. Because connectors 178 interconnect with receptacles 122 and 123, receptacles 122 and 123 are more stable and less likely to move within tray 18 while rollers are withdrawing paint. Because connectors 178 permit trays 122 and 123 to be separated from one another, trays 122 and 123 may be removed for withdrawing paint, for cleaning or for being replaced with another receptacle containing a different colored paint. Although connectors 178 of receptacles 122 and 123 are illustrated as overlapping rims, various other conventionally known connection structures and methods may be used for releasibly interconnecting adjacent receptacles 122 and 123.

As shown by FIG. 10, tray connectors 180 extend along side walls 176 opposite receptacle connectors 178. Tray connectors 180 are configured for releasibly securing receptacles 122 and 123 to tray 18. In the exemplary embodiment illustrated, connectors 180 comprise locking rims, similar to connectors 178, but configured for mating with and receiving at least portions of rims of side walls 60 and 62 of tray 18. Similar to connectors 178, tray connectors 180 each include a horizontal flange 198 and a downwardly turned lip 200 which form a channel 202 configured for mating and receiving at least a portion of an upper edge of either side walls 60 or 62 of tray 18. Because connectors 180 releasibly interconnect receptacles 122 and 123 to tray 18, receptacles 122 and 123 are more stably secured within basin 64 of tray 18 to prevent movement of receptacles 122 and 123 while rollers are withdrawing paint. Because connectors 180 releasibly interconnect receptacles 122 and 123 to tray 18, receptacles 122 and 123 may be separated and withdrawn from tray 18 for cleaning and replacement of receptacles 122 and 123. As can be appreciated, various other connecting structures and methods, such as locking tabs or other components, may be used for releasibly interconnecting receptacles 122 and 123 to tray 18.

In conclusion, paint supply and finishing system 10 provides several advantages over conventional paint supply and finishing systems. First, paint roller 30 is sturdy, simple to manufacture and versatile. Because paint roller 30 supports a single shaft 40 from handle 38, less stress is placed upon handle 38 and handle 38 is less likely to crack or fatigue over time. Moreover, roller 30 may be manufactured using conventional manufacturing techniques associated with single shafted roller frames. Because roller cages 42 and 44 are rotatably supported about a single elongate shaft 40, cages 42 and 44 may be used to rotatably support two independent roller covers or may be used to support a single longer roller cover as used in conventional painting. Thus, roller 30 is versatile in that roller 30 can be used for specialized paint finishing applications or for regular painting applications.

Second, paint supply system 12 is also easier to use, simpler to manufacture and more versatile. Because tray inserts 20 and 120 are removably positionable within an outer tray 18, inserts 20 and 120 may be supported by tray 18 and may be made from thinner and less expensive material. At the same time, tray 18 may also be used for conventional roller painting applications. Because inserts 20 and 120 each include pour spouts 93, unused paint may be easily removed from inserts 20 and 120. Moreover, lid 22 enables paint to be stored within paint supply system 12. Because inserts 20 and 120 include partitioning walls which have a top edge that interacts with the intermediate surface 92 of roller 30, inserts 20 and 120 regulate the extent to which roller covers 32 and 34 are dipped into paint wells 86 to prevent covers 32 and 34 from absorbing an excessive amount of paint. In addition, the paint metering mediums 90 also prevent covers 32 and 34 from absorbing and carrying excessive amounts of paint. As a result, less paint is waisted and less time is spent removing excessive paint from covers 32 and 34, or cover 96. In addition to those advantages associate with insert 20, insert 120 is modular in nature such that the individual pans within tray 18 may be removed or replaced to provide a multitude of paint color combinations. Moreover, because the receptacles of inserts 120 are configured for releasible attachment to one another and for releasible attachment to side walls 60 and 62 of tray 18, insert 120 may be securely locked in place within tray 18.

As can be appreciated, paint supply and finishing system 10 may have various other configurations while still embodying the concepts of the present invention. For example, roller 30 may alternatively be configured to support greater than two roller cages and roller covers along shaft 40. In lieu of being removable from cages 42 and 44, covers 32 and 34 may alternatively be integrally formed with cages 42 and 44 or may be directly rotatably coupled to shaft 40 without the use of cages 42 and 44. Paint supply system 12 may also alternatively utilize a single tray having integrally formed partition walls to divide the tray receptacle into multiple compartments. Although the exemplary embodiments illustrate two side-by-side pans 26 and 28 and two side-by-side receptacles 122, 124, system 12 may include greater than two side-by-side compartments utilizing the same inventive features discussed above. Furthermore, although less desirable, receptacles 122 and 124 may be simply removably positionable within tray 18 without being releasibly attached to tray 18. Those skilled in the art will appreciate that certain of these advantages can be obtained separately through reconfiguring the foregoing structure without departing from the spirit and scope of the present invention as outlined in the appended claims.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A paint roller and tray system comprising:

a tray including:

a floor;

a plurality of upstanding walls extending from the floor to form a basin; and a partitioning wall configured for being removably positioned within the basin to create first and second pans within the basin configured for simultaneously receiving roller covers; and a paint roller including:

a handle;

a continuous elongate shaft coupled to the handle;

a first roller cover rotatably supported about the shaft; and a second roller cover rotatably supported about the shaft, wherein the first and second roller covers are axially spaced from one another so as to independently rotate relative to one another and so as to be simultaneously positionable within the first and second pans.

2. The system of claim 1, wherein the partitioning wall includes a top surface, wherein the paint roller includes an intermediate surface axially extending between the first and second roller covers and wherein the top surface of the partitioning wall and the intermediate surface of the paint roller interact with one another to regulate insertion of the first and second roller covers into the first and second pans.

3. The system of claim 1, including a spacer positioned between the first and second roller covers.

4. The system of claim 1, wherein the paint roller includes first and second roller cages independently rotatably about the shaft, wherein the first and second cages rotatably support the first and second roller covers.

5. The system of claim 1, wherein the partitioning wall is configured for being releasibly attached to the tray.

6. The system of claim 1, including a receptacle configured for being received within the basin and for receiving roller covers.

7. The system of claim 1, including a plurality of receptacles configured for being simultaneously and individually received within the basin and for simultaneously and individually receiving roller covers.

8. The system of claim 7, wherein the plurality of receptacles are configured for being releasibly attached to one another.

9. The system of claim 1, including a paint metering medium within at least one of the first and second pans.

10. The system of claim 9, wherein the paint metering medium applies a variable amount of paint to the roller cover based upon force applied by the roller cover to the medium.

11. The system of claim 9, wherein the paint metering medium comprises a paint absorbent medium, wherein the medium absorbs paint and releases paint onto the roller cover when in contact with the roller cover.

12. The system of claim 11, wherein the paint absorbing medium is a paint absorbent foam.

13. The system of claim 9, wherein said at least one of the first and second pans includes a well containing the medium and a ramp extending from the well.

14. The system of claim 1, wherein each pan includes a pour spout.

15. A roller frame comprising:

a continuous elongate shaft having a first portion extending along an axis from a first end to a second end and a second portion angularly extending from the second end of the first portion;

a handle coupled to the second portion;

a first roller cage rotatably supported about the first portion of the shaft; and a second roller cage rotatably supported about the first portion of the shaft, the first and second cages being axially spaced from one another; and a spacer positioned between the first and second cages, whereby the first and second cages rotate relative to one another when supporting distinct covers and whereby the first and second cages can simultaneously support a common roller cover.

16. A roller assembly comprising:

a continuous elongate shaft having a first portion extending along an axis from a first end to a second end and a second portion angularly extending from the second end of the first portion;

a handle coupled to the second portion;

a first roller cover rotatably supported about the first portion of the shaft; and a second roller cover rotatably supported about the first portion of the shaft, the first and second roller covers being axially spaced from one another; and a spacer positioned between the first and second roller covers.

17. A tray insert for use with a tray having a floor and a plurality of upstanding walls forming a basin, the insert comprising:

at least one partitioning wall;

a plurality of upstanding walls; and a floor, wherein the plurality of upstanding walls and the partitioning wall extend from the floor to form a receptacle configured for being received within the basin so as to divide the basin into a plurality of distinct pans configured for receiving roller covers each of the pans including a well and a ramp extending therefrom.

18. The insert of claim 17, wherein the partitioning wall is configured for being releasibly attached to the tray.

19. The insert of claim 17, including a paint metering medium within at least one of the pans.

20. The insert of claim 19, wherein the paint metering medium provides paint to a roller based upon forces applied by the roller to the medium.

21. The insert of claim 19, wherein the paint metering medium comprises a paint absorbing medium, wherein the medium absorbs paint and releases the paint onto a roller when in contact with the roller.

22. The insert of claim 21, wherein the paint absorbing medium comprises a foam material.

23. The insert of claim 21, wherein at least one of the wells contain the medium.

24. A paint supply system for use with a roller having a plurality of spaced roller covers, the system comprising:

a tray having a floor and a plurality of upstanding walls extending from the floor to form a basin; and first and second paint receptacles configured to be simultaneously received within the basin, each receptacle including a connecting portion, wherein the connecting portions cooperate to releasably connect the first and second receptacles when the receptacles are received within the basin, each receptacle further including a floor and a plurality of upstanding walls extending from the floor to define a pan, wherein adjacent walls of adjacent receptacles are sized such that adjacent receptacles may simultaneously receive independent roller covers supported by a single handle.

25. The system of claim 24, wherein each receptacle includes a pour spout.

26. The system of claim 25, wherein each receptacle includes a cover configured for covering the pan and the pour spout.

* * * * *